US008499388B1

(12) United States Patent
Copes

(10) Patent No.: US 8,499,388 B1
(45) Date of Patent: Aug. 6, 2013

(54) FOLDING CHAIR PAD

(76) Inventor: Rene J. Copes, Chesaning, MI (US)

( * ) Notice: Subject to any disclaimer, the term of this patent is extended or adjusted under 35 U.S.C. 154(b) by 0 days.

(21) Appl. No.: 12/822,178

(22) Filed: Jun. 23, 2010

Related U.S. Application Data

(60) Provisional application No. 61/219,724, filed on Jun. 23, 2009.

(51) Int. Cl.
*A47C 31/00* (2006.01)
*B68G 5/00* (2006.01)

(52) U.S. Cl.
USPC ..... 5/653; 5/656; 297/219.1

(58) Field of Classification Search
USPC ..... 5/653, 656; 297/219.1, 230.14, 228.1
See application file for complete search history.

(56) References Cited

U.S. PATENT DOCUMENTS

| | | | | |
|---|---|---|---|---|
| 4,190,918 | A * | 3/1980 | Harvell | 5/653 |
| 4,597,605 | A | 7/1986 | Gilbert | |
| D293,868 | S | 1/1988 | Paletta et al. | |
| 4,838,378 | A | 6/1989 | Copes | |
| D312,741 | S | 12/1990 | Treadwell | |
| D338,580 | S | 8/1993 | Evans | |
| 5,234,252 | A * | 8/1993 | Wallach | 297/229 |
| D342,638 | S | 12/1993 | Harland | |
| 5,297,848 | A | 3/1994 | Grinnell | |
| D357,609 | S | 4/1995 | Webb et al. | |
| 5,573,288 | A * | 11/1996 | Raffensperger | 297/188.12 |
| 5,855,415 | A * | 1/1999 | Lilley, Jr. | 297/452.27 |
| 6,050,639 | A * | 4/2000 | Horn | 297/229 |
| 6,116,693 | A * | 9/2000 | Zammit | 297/440.22 |
| 6,409,264 | B1 * | 6/2002 | Palmer et al. | 297/218.3 |
| D474,934 | S * | 5/2003 | Ildstad et al. | D6/601 |
| 6,588,840 | B1 * | 7/2003 | Lombardo | 297/228.12 |
| 7,448,681 | B1 * | 11/2008 | Spitzer | 297/228.13 |
| 7,618,092 | B2 * | 11/2009 | Yasuda et al. | 297/224 |
| 7,774,880 | B1 * | 8/2010 | Botts | 5/656 |
| 2004/0155499 | A1 * | 8/2004 | Chambers et al. | 297/228.1 |

* cited by examiner

*Primary Examiner* — Robert G Santos
*Assistant Examiner* — Brittany Wilson
(74) *Attorney, Agent, or Firm* — Robert L. Farris; Farris Law, P.C.

(57) ABSTRACT

The folding chair pad includes a rectangular resilient foam cushion with an upper surface, a lower surface and four side surfaces. A fabric top panel covers cushion upper surface. A fabric bottom panel covers cushion bottom surface. A fabric band covers the side surfaces and is sewn to the top and bottom panels to encase the foam cushion. The cushion is compressed and tensions the fabric members when the pad is not in use. An envelope is formed on the bottom panel by a lower fabric panel and a partial fabric band. The envelope has a rearward facing opening that receives the front portion of a chair seat. A retainer flap is sewn to the rear end of the bottom panel and is attached to the rear of the chair seat.

11 Claims, 7 Drawing Sheets

FOLDING CHAIR PAD

CROSS REFERENCE TO RELATED APPLICATION

This application claims the benefit of the filing date of U.S. Provisional Application No. 61/219,724, titled FOLDING CHAIR PAD filed Jun. 23, 2009.

TECHNICAL FIELD

The Chair pad is a fabric member with an encased cushion member and an integral retaining system that substantially limits movement of the pad relative to a chair seat and permits the chair to be folded and stored without removing the pad.

BACKGROUND OF THE INVENTION

Folding metal chairs are employed by schools, churches, other organizations, and home owners. Folding chairs provide seating when needed. When the folding chairs are not needed, they can be folded and stored for future use. When there is a substantial number of folding chairs, racks with wheels are available for storage and movement of folding chairs.

The metal seat on folding chairs may be cold in the winter and hot in the summer. The metal seat is also hard and uncomfortable. The discomfort can be tolerated for a short period of time. However after a few minutes a metal seat of a folding chair can become very uncomfortable. Folding metal chairs seem to bother older people more than young people.

Metal folding chairs are generally painted to prevent rust and corrosion. After a period of use the metal seat becomes worn and scratched. Some of these chairs, after a period of use, are unsightly. Refinishing metal chairs requires preparation. Preparation is generally requires hard manual work. Painting after preparation and cleaning requires a paint room with fresh air breathing apparatus and a ventilation system that cleans air discharged from the room. In some cases it is less expensive to purchase new chairs than it is to clean and refurbish used folding chairs.

Temporary cushions have been employed to reduce the discomfort associated with sitting on a metal surface of a folding chair seat. Loose cushion tend to slide on the surface of a metal seat. A person using a loose cushion should check the position of a loose cushion before sitting down. Straps that tie the rear corners of a cushion to a chair frame can hold the cushion in place for sitting. However, the two straps do not hold the pad in place when a chair is folded for storage. The two straps may hinder folding the chair to or form a folded storage position. The two retainer straps may also permit movement of a cushion into a position in which storage of a chair is hindered by the cushion.

SUMMARY OF THE INVENTION

The folding chair pad includes a resilient closed cell foam cushion. The cushion includes a cushion upper surface, a cushion bottom surface, a cushion left side surface, a cushion right side surface, a cushion front end surface, and a cushion rear end surface. The cushion left side surface is generally parallel to the cushion right side surface. The left side surface is spaced from the cushion right side surface a distance that is substantially the width of a folding chair seat. The cushion front end surface is generally parallel to the cushion rear end surface. The cushion front end surface is spaced from the cushion rear end surface a distance substantially the fore and aft length of the folding chair seat.

A flexible fabric top panel covers the cushion upper surface entirely. A flexible fabric bottom panel covers the cushion bottom surface entirely. A flexible fabric side band is sewn to the flexible fabric top panel. The flexible fabric band is also sewn to the flexible fabric bottom panel. The flexible fabric band covers the cushion left side surface, the cushion right side surface, the cushion front end surface, and the cushion rear end surface and thereby encases the resilient closed cell foam cushion. The cushion left side surface, the cushion right side surface, the cushion front end surface, and the cushion rear end surface have a vertical height relative to the flexible fabric side band that permits the resilient closed cell foam cushion to tension the flexible fabric top panel, the flexible fabric bottom panel, and the flexible fabric side band when the folding chair pad is not in use.

An envelope of flexible fabric includes a lower fabric panel with a lower panel left side, a lower panel front end, a lower panel right side, and a lower panel rear edge. The lower panel rear edge is generally parallel to the lower panel front end. A partial flexible fabric band is sewn to the lower panel left side, sewn to the lower panel front end and sewn to the lower panel right side. The partial flexible fabric band is also sewn to the flexible bottom panel adjacent to the cushion front end surface, sewn to a portion of the flexible bottom panel adjacent to the cushion left side surface, and sewn to a portion of the flexible bottom panel adjacent to the cushion right side surface. The lower panel rear edge is between the cushion rear surface and the cushion front end surface. The lower panel cooperates with the flexible fabric bottom panel and the partial flexible fabric band to form an envelope opening that receives a folding chair front seat end. The lower panel rear edge is also adjacent to and forward of a transverse folding axis of the folding chair seat.

A flexible fabric retainer flap is sewn to the flexible fabric bottom panel adjacent to the cushion rear end surface. A retainer holds the flexible fabric retainer adjacent to a seat rear end. The retainer includes a hook and loop connector. The connector has a first connector member is sewn to the flexible fabric retainer flap and a second connector member attached to the folding chair seat. The second connector member is attached to the folding chair seat by an adhesive.

BRIEF DESCRIPTION OF DRAWINGS

The presently preferred embodiment of the invention is disclosed in the following description and in the following drawings, wherein.

DETAILED DESCRIPTION OF THE PREFERRED EMBODIMENTS

Figure 1:
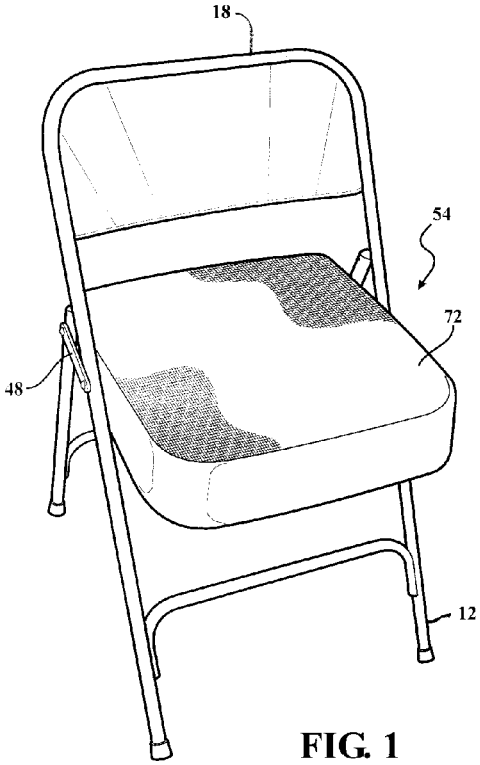
FIG. 1 is a perspective view of the front and right side of a metal folding chair in an unfolded use position, with a folding chair seat pad.
Figure 2:
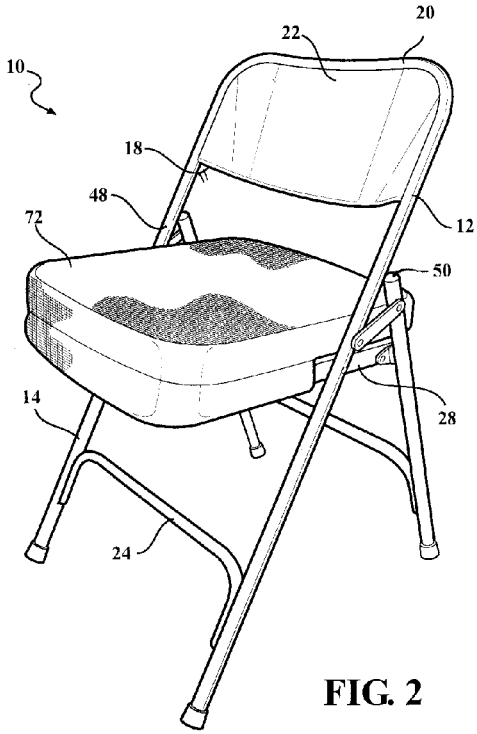
FIG. 2 is a perspective view of the front and left side of a metal folding chair, with a folding chair seat pad.
Figure 3:
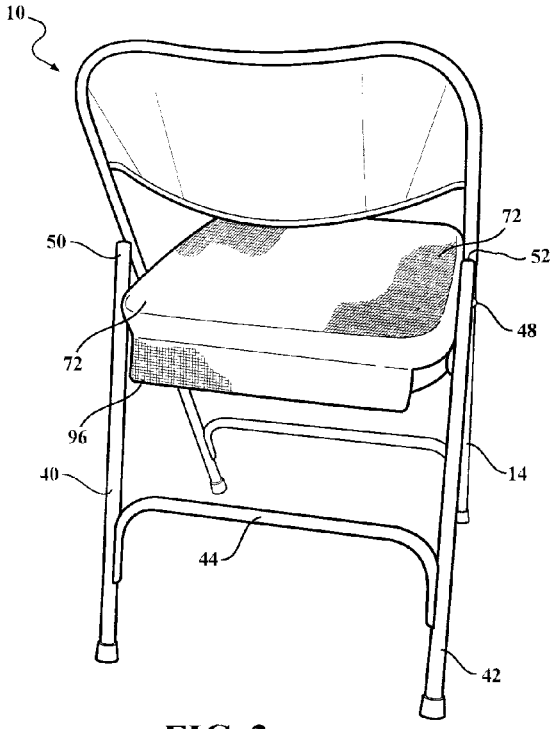
FIG. 3 is a perspective view of the rear and top of a metal folding chair, with a folding chair seat pad.
Figure 4:
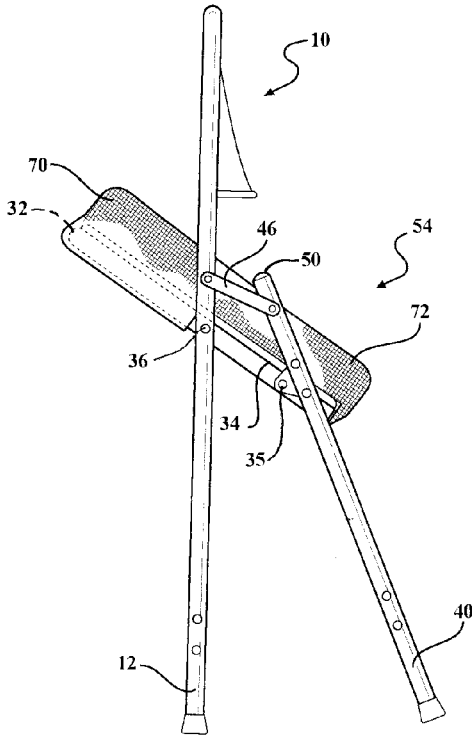
FIG. 4 is a left side elevational view of a metal folding chair, with a folding chair seat pad, partially folded to a storage position.
Figure 5:
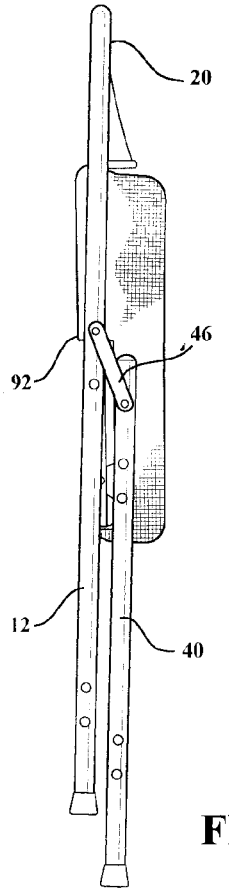
FIG. 5 is a left side elevational view of a metal folding chair, with a folding chair seat pad, in a folded storage position.
Figure 6:
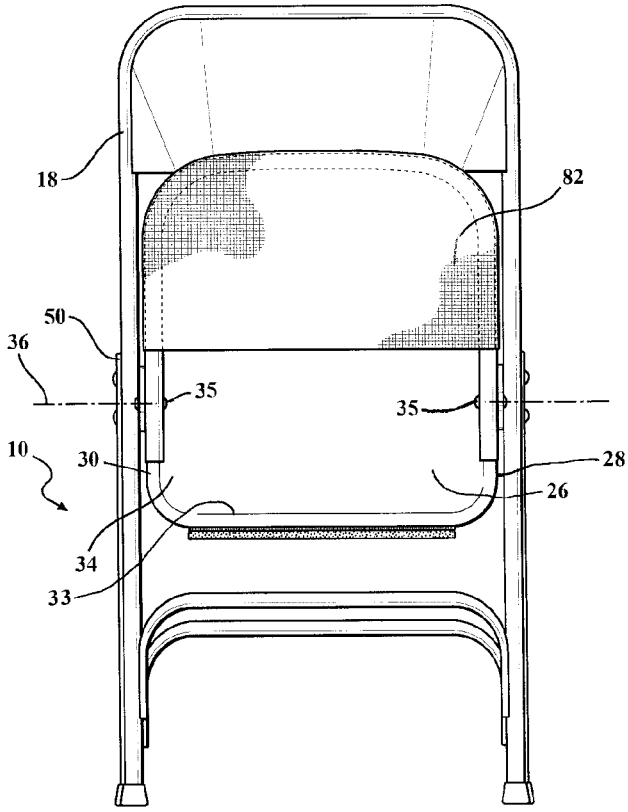
FIG. 6 is a front elevational view of a metal folding chair, with a folding chair seat pad, in a folded storage position.
Figure 7:
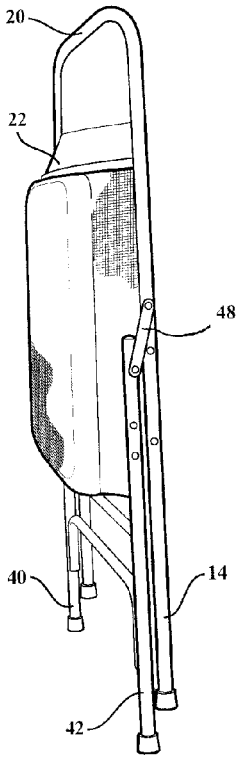
FIG. 7 is a perspective view of the right side and rear of a metal folding chair, with a folding chair seat pad, in a folded storage position.
Figure 8:
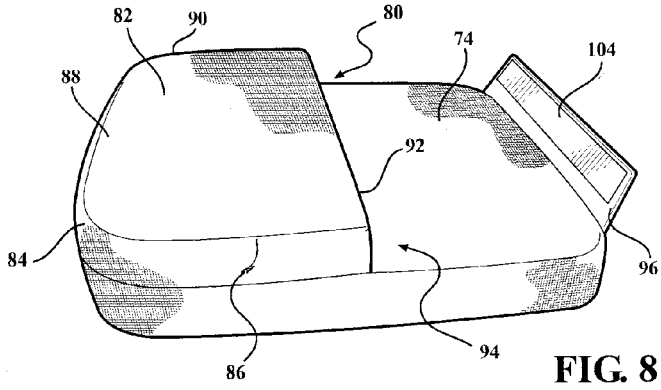
FIG. 8. is a perspective view of the bottom and right side of the folding chair seat pad.
Figure 9:
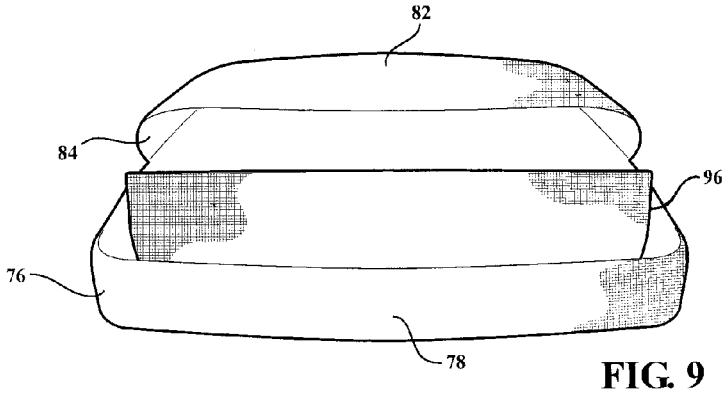
FIG. 9 is a perspective view of the bottom and rear of the folding chair seat pad.
Figure 10:
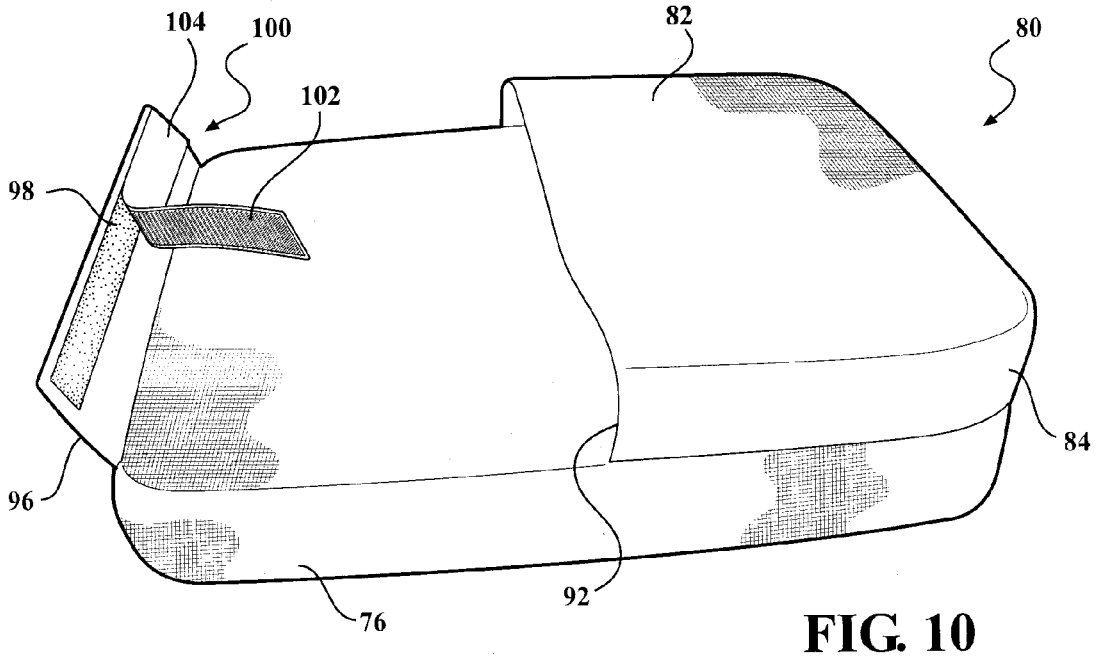
FIG. 10 is a perspective view of the bottom and left side of the folding chair seat pad with a hook and loop fastener partially disengaged.
Figure 11:
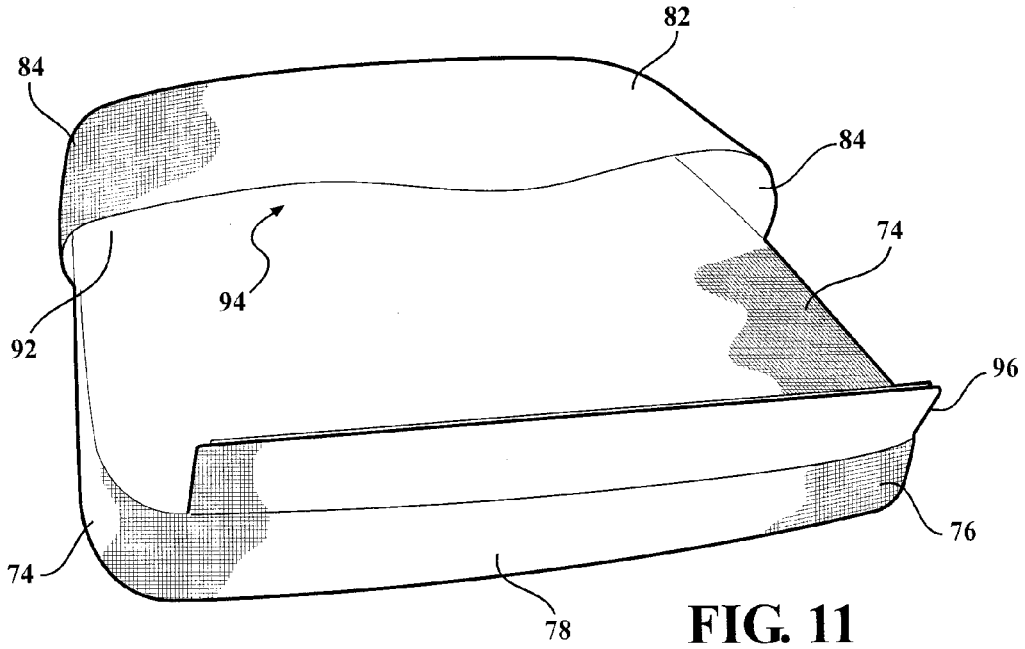
FIG. 11 is a perspective view of the bottom, rear end and right side of the folding chair seat pad.
Figure 12:
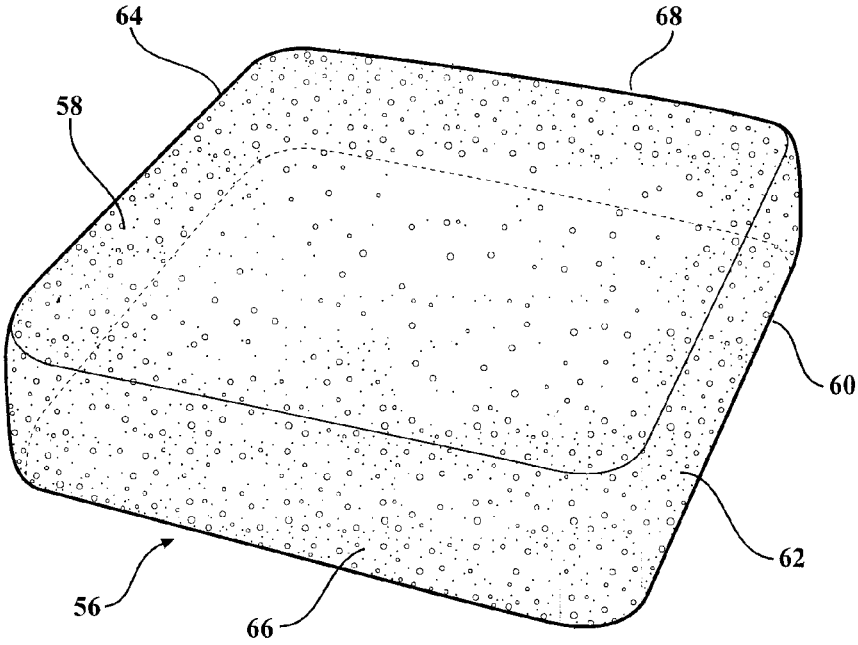
FIG. 12 is a perspective view foam cushion.
Figure 13:
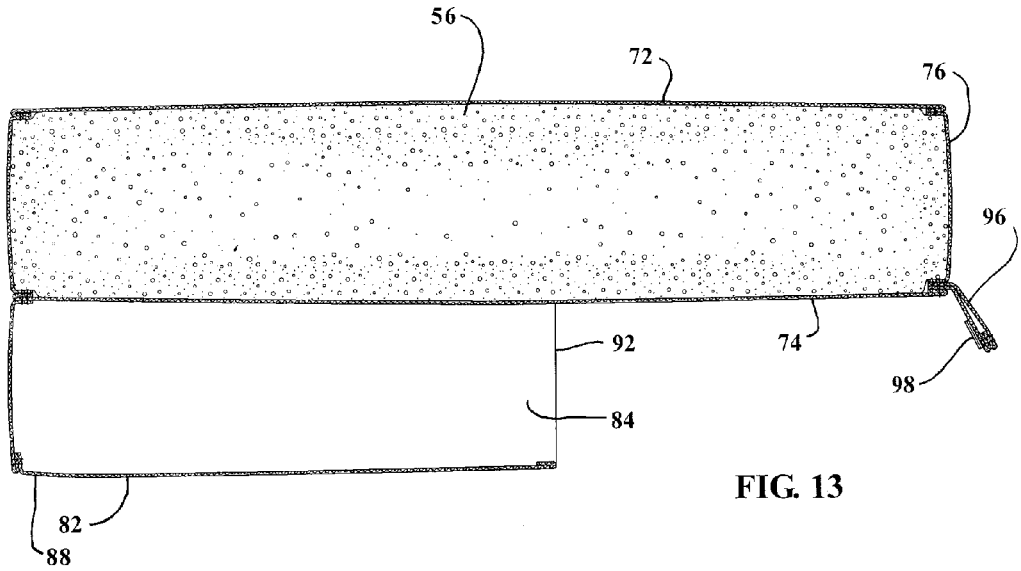
FIG. 13 is a vertical fore and aft sectional view through the center portion of the folding chair seat pad.

Folding chairs 10 vary in construction from one manufacturer to another. One such chair has a left front leg 12 and a right front leg 14. The front legs 12 and 14 are part of an inverted U-shaped member 18 with an integral upper cross beam 20. A back rest 22 is connected to the cross beam 20 and to the upper portions of the left front leg 12 and the upper portion of the right front leg 14. A lower cross beam 24 is connected to the lower portion of the left front leg 12 and the right front leg 14.

A chair seat 26 is a substantially rectangular member with a left seat side 28, a right seat side 30 a front seat end 32, a rear seat end 33 and a seat top wall 34. The chair seat 26 may be made from one piece of metal or from multiple pieces. When made from multiple pieces, the parts may be made from different material.

The chair seat 26 is pivotally connected the left front leg 12 and the right front leg 14 for pivotal movement about a transverse horizontal folding axis 36. The folding axis 36 passes through the left front leg 12 and the right front leg 14 of the U-shaped member 18 midway between integral upper cross beam 20 and the bottom end of the U-shaped member. The folding axis 36 in the folding chair 10 shown is slightly closer to the upper cross beam 20 than to the lower end of the U-shaped member 18. The folding axis 36 also passes through the left seat side 28 and the right seat side 30. The folding axis 36 in the folding chair 10 shown is somewhat closer to the rear seat end 33 than to the front seat end 32.

A left rear leg 40 is pivotally attached to the left seat side 28 a short distance forward of the rear seat end 33 by pivot pins 35. A right rear leg 42 is pivotally attached to the right seat side 30 a short distance forward of the rear seat end 33 by a second pivot pin 35. A rear horizontal cross bar 44 is fixed to lower portions of the left rear leg 40 and the right rear leg 42. A left connector link 46 is pivotally attached to the left front leg 12 and to the left rear leg 40. A right connector link 48 is pivotally attached to the right front leg 14 and to the right rear leg 42. A left stop surface 50 on the top end of the left rear leg 40 contacts the left front leg 12 when the folding chair 10 is in an unfolded use position. A right stop surface 52 on the top end of right rear leg 42 contacts the right front leg 14 when the folding chair 10 is in an unfolded use position.

The cushion assembly 54 includes a resilient closed cell foam cushion 56. This cushion 56 has a cushion upper surface 58, a cushion bottom surface 60, a cushion left side 62 a cushion right side 64 a cushion front end 66 and a cushion rear end 68. The thickness of the cushion 56 can vary depending upon factors such as the size of expected users and the choice of the chair's owner. If the chair 10 is to be used by children under age twelve, a thickness of one inch or even less may be sufficient. If the chair 10 is to be used by older children or adults, a thickness between one and a half inches and two and a half inches may be desirable. Cushions 56 can be made from material that is very firm, very soft or in between.

The cushion upper surface 58 and the cushion bottom surface 60 are both flat as shown in the drawing. The seat top wall 34 on some chairs is contoured to improve comfort. The resilient closed sell cushion may have a contoured bottom surface 60 that conforms to the contour of the seat top wall 34 to limit movement of the cushion assembly 54 relative to the seat top wall 34. Such a contoured bottom surface will reduce internal forces in the resilient cushion 56 and may extend the useful life of the resilient cushion.

The cushion upper surface 58 may be contoured to evenly distribute a person's weight over a larger area. A cushion upper surface 58 that is contoured to distribute weight over a larger area is desirable when the foam material is very firm. The contoured cushion upper surface 58 on the chair 10 is also desirable when the chair is to be used for extended periods of time. Use for two hours or more can be an extended period of time.

The cushion assembly 54 includes a fabric material 70 that encases the cushion 56. The fabric is preferably durable and flexible. A fabric top panel 72 is the same size and shape as the cushion upper surface 58 and seat top wall 34. A fabric bottom panel 74 is the same size and shape as the fabric top panel 72. A side band 76 of fabric is sewn to the edges of the fabric top panel 72 and to the fabric bottom panel 74 and encircles the cushion 56. The ends of the side band 76 are sewn together at 78 near the center of the cushion rear end 68. The foam cushion 56 is completely encased by the fabric top panel 72, the fabric bottom panel 74 and the side band 76. It is generally desirable for the fabric cover of the cushion assembly 54 to slightly compress the cushion 56 to maintain tension on the fabric material 70 when the cushion assembly is not in use. The tension on fabric material 70 will limit wrinkles improve appearance and limit wear.

An envelope 80 is formed on the bottom of the cushion assembly 54. The envelope 80 is formed by a lower fabric panel 82 and a partial fabric band 84. The lower fabric panel 82 is substantially the size of the forward half of the fabric bottom panel 74. A partial fabric band 84 is sewn to the lower panel left side 86, the lower panel front end 88 and the lower panel right side 90. The partial fabric band 84 is also sewn to the forward portion of the fabric bottom panel 74 left side, front end and right side. Stitches that connect the partial fabric band 84 to the forward portion of the bottom panel 74 also connect the bottom panel to the side band 76 of the cushion assembly. A rear edge 92 of the lower fabric panel 82 is hemmed for strength and durability. The rear edge 92 of the lower fabric panel 82 the partial fabric band 84 and the fabric bottom panel 74 forms an envelope opening 94 in the envelope 80 that faces rearward. The vertical height of the partial fabric band 84 is substantially the same as the vertical height of the front seat end 32 of the chair seat 26.

A retainer flap 96 is sewn to the rear of the fabric bottom panel 74. The retainer flap 96 is two layers of the fabric material 70 that are sewn together for strength. The retainer flap 96 is also sewn to the side band 76 of the cushion assembly 54 by the stitches that connect the side band to the fabric bottom panel 74. One connector member 98 of a hook and loop connector 100 is sewn to the retainer flap 96. Another connector member 102 includes an adhesive strip 104 that is attached to the rear seat end 33 of the chair seat 26.

During use the front seat end 32 of the chair seat 26 is received in the envelope opening 94 of the envelope 80. The cushion assembly 54 is moved rearward relative to the chair seat 26 as far as it will go. The retainer flap 96 is folded downward until the connector member 98 of the hook and loop connector 100 engages the other connector member 102 attached to the rear seat end 33 by an adhesive. The hook and loop connector member 100 limits forward movement of the cushion assembly 54 and limits movement of the rear portion of the cushion assembly 54 to the left or to the right. The envelope 80 limits rearward movement of the cushion assembly 54. The envelope 80 also limits vertical movement and side to side movement of the forward portion of the cushion assembly 54 relative to the chair seat 26.

I claim:

1. A folding chair pad comprising:

a resilient foam cushion including a cushion upper surface, a cushion bottom surface a cushion left side surface, a cushion right side surface, a cushion front end surface and a cushion rear end surface and wherein the cushion left side surface is generally parallel to the cushion right side surface and spaced from the cushion right side surface a distance substantially the width of a folding chair seat, the cushion front end surface is generally parallel to the cushion rear end surface and spaced from the cushion rear end surface a distance substantially the fore and aft length of the folding chair seat;

a fabric top panel that covers the cushion upper surface entirely, a fabric bottom panel that covers the cushion bottom surface entirely, a fabric side band sewn to the fabric top panel and sewn to the fabric bottom panel, covering the cushion left side surface, the cushion right side surface, the cushion front end surface, the cushion rear end surface and thereby encasing the resilient foam cushion and forming a cushion assembly;

an envelope of fabric including a lower fabric panel with a lower panel left side, a lower panel front end, a lower panel right side, a lower panel rear edge generally parallel to the lower panel front end, a partial fabric band having a partial band lower edge sewn to the lower panel left side, sewn to the lower panel front end, sewn to the lower panel right side, having a partial band upper edge sewn to the fabric bottom panel, covering the cushion bottom surface, adjacent to the cushion front end surface, sewn to a portion of the bottom panel adjacent to the cushion left side surface, sewn to a portion of the bottom panel adjacent to the cushion right side surface and wherein the lower panel rear edge is between the cushion rear end surface and the cushion front end surface and the lower panel cooperates with the fabric bottom panel and the partial fabric band to form an envelope opening, that receives a folding chair front seat end, which is substantially the same as a width of the resilient foam cushion from the cushion left side surface to the cushion right side surface and an envelope opening height from the fabric bottom panel to the lower fabric panel that is substantially the same height as a vertical height of the folding chair front seat end and wherein the envelope extends from the envelope opening to the lower panel front end and from the cushion left side surface to the cushion right side surface; and a single fabric retainer flap sewn to the flexible fabric bottom panel adjacent to the cushion rear end surface, extending substantially the width of the fabric bottom panel a retainer holding the fabric retainer flap adjacent to a seat rear end of a folding chair seat that is pivotal about a "transverse horizontal folding axis.

2. A folding chair pad, as set forth in claim 1 wherein said retainer holding the fabric retainer flap adjacent to the seat rear end is a hook and loop connector with a first connector member sewn to the fabric retainer flap and a second connector member attached to the folding chair seat by an adhesive.

3. A folding chair pad, as set forth in claim 1, wherein the fabric side band has a vertical height that holds the fabric top panel in a position relative to the fabric bottom panel that reduces the dimensions of said cushion assembly and compresses the resilient foam cushion is compressed between the fabric top panel and the fabric bottom panel when the folding chair pad is not in use and mounted on the folding chair seat thereby maintaining the fabric free of wrinkles.

4. A folding chair pad, as set forth in claim 1, wherein the envelope of fabric engages the folding chair seat and limits movement of the folding chair pad relative to the folding chair seat to the right, to the left and to the rear; and wherein the fabric retainer flap and the retainer limit forward movement of the folding chair pad relative to the folding chair seat.

5. A folding chair pad comprising:

a resilient closed cell foam cushion including a cushion upper surface, a cushion bottom surface a cushion left side surface, a cushion right side surface, a cushion front end surface, and a cushion rear end surface and wherein the cushion left side surface is generally parallel to the cushion right side surface and spaced from the cushion right side surface a distance substantially the width of a folding chair seat, the cushion front end surface is generally parallel to the cushion rear end surface and spaced from the cushion rear end surface a distance substantially the fore and aft length of the folding chair seat;

a flexible fabric top panel that covers the cushion upper surface entirely, a flexible fabric bottom panel that covers the cushion bottom surface entirely, a flexible fabric side band sewn to the flexible fabric top panel and sewn to the flexible fabric bottom panel, covering the cushion left side surface, the cushion right side surface, the cushion front end surface, the cushion rear end surface and thereby encasing the resilient closed cell foam cushion and forming a cushion assembly;

an envelope of flexible fabric including a lower fabric panel with a lower panel left side, a lower panel front end, a lower panel right side, a lower panel rear edge generally parallel to the lower panel front end, a partial flexible fabric band with a partial band lower edge sewn to the lower panel left side, sewn to the lower panel front end, sewn to the lower panel right side, having a partial band upper edge sewn to flexible fabric bottom panel covering the cushion bottom surface, adjacent to the cushion front end surface, sewn to a portion of the flexible bottom panel adjacent to the cushion left side surface, sewn to a portion of the flexible bottom panel adjacent to the cushion right side surface and wherein the lower panel rear edge is between the cushion rear end surface and the cushion front end surface and the lower panel cooperates with the flexible fabric bottom panel and the partial flexible fabric band to form an envelope opening which is substantially the same width as the width of the resilient closed cell foam cushion from the cushion left side surface to the cushion right side surface and an envelope opening height from the fabric bottom panel to the lower fabric panel that is substantially the same height as a vertical height of a folding chair front seat end and wherein the partial flexible fabric band has a vertical height that is substantially the same as the folding chair seat front end height; and a flexible fabric retainer flap sewn to the flexible fabric bottom panel adjacent to the cushion rear end surface, extending substantially the width of the fabric bottom panel and a retainer holding the flexible fabric retainer flap adjacent to a seat rear end.

6. A folding chair pad, as set forth in claim 5, wherein the envelope completely covers all surfaces of the folding chair seat forward of the lower panel rear edge.

7. A folding chair pad, as set forth in claim 5, wherein the fabric side band has a vertical height that holds the fabric top panel in a position relative to the fabric bottom panel that reduces the dimensions of said cushion assembly and compresses the cushion upper surface and the cushion bottom surface when the folding chair pad is mounted on a folding chair seat that is pivotal about a transverse horizontal folding axis, and that is not in use.

8. A folding chair pad, as set forth in claim 5, wherein the lower panel rear edge of the lower fabric panel is between a transverse horizontal folding axis of the folding chair seat and the folding chair front seat end.

9. A folding chair pad, as set forth in claim 5 wherein the lower panel rear edge of the lower fabric panel is closer to the cushion rear end surface than to the cushion front end surface.

10. A folding chair pad comprising:

a resilient closed cell foam cushion including a cushion upper surface, a cushion bottom surface, a cushion left side surface, a cushion right side surface, a cushion front end surface, and a cushion rear end surface and wherein the cushion left side surface is generally parallel to the cushion right side surface and spaced from the cushion right side surface a distance substantially the width of a folding chair seat, the cushion front end surface is generally parallel to the cushion rear end surface and spaced from the cushion rear end surface a distance substantially the fore and aft length of the folding chair seat;

a flexible fabric top panel that covers the cushion upper surface entirely, a flexible fabric bottom panel that covers the cushion bottom surface entirely, a flexible fabric side band sewn to the flexible fabric top panel and sewn to the flexible fabric bottom panel, covering the cushion left side surface, the cushion right side surface, the cushion front end surface, the cushion rear end surface and thereby encasing the resilient closed cell foam cushion and wherein the cushion left side surface, the cushion right side surface, the cushion front end surface, and the cushion rear end surface have a vertical cushion height from the cushion bottom surface to the cushion top surface that exceeds a side band vertical height of the flexible fabric side band to tension the flexible fabric top panel, and the flexible fabric side band when the folding chair pad is not in use and mounted on the folding chair seat that is pivotal about a transverse horizontal folding axis;

an envelope of flexible fabric including a lower fabric panel with a lower panel left side, a lower panel front end, a lower panel right side, a lower panel rear edge generally parallel to the lower panel front end, a partial flexible fabric band with a partial band lower edge sewn to the lower panel left side, sewn to the lower panel front end, sewn to the lower panel right side, having a partial band upper edge sewn to the flexible bottom panel adjacent to the cushion front end surface, sewn to a portion of the flexible bottom panel adjacent to the cushion left side surface, sewn to a portion of the flexible bottom panel adjacent to the cushion right side surface and wherein the lower panel rear edge is between the cushion rear end surface and the cushion front end surface and the lower panel cooperates with the flexible fabric bottom panel and the partial flexible fabric band to form an envelope opening, that receives a folding chair front seat end, which is substantially the same width as a width of the resilient foam cushion from the cushion left side surface to the cushion right side surface and an envelope opening height from the fabric bottom panel to the lower fabric panel that is substantially the same height as a vertical height of the folding chair front seat end and wherein the envelope extends from the envelope opening to the lower panel front end and wherein the lower panel rear edge is adjacent to and forward of a transverse folding axis of the folding chair seat; and a flexible fabric retainer flap sewn to the flexible fabric bottom panel adjacent to the cushion rear end surface and a retainer holding the flexible fabric retainer flap adjacent to a seat rear end including a hook and loop connector with a first connector member sewn to the flexible fabric retainer flap and a second connector member attached to the folding chair seat.

11. A folding chair pad, as set forth in claim 10, wherein the second connector member is attached to the folding chair seat by an adhesive.

* * * * *